US007634991B2

(12) United States Patent
Yeh

(10) Patent No.: US 7,634,991 B2
(45) Date of Patent: Dec. 22, 2009

(54) PAINTBALL GUN PERCUSSION STRUCTURE

(75) Inventor: Hsin-Cheng Yeh, Tainan Hsien (TW)

(73) Assignee: Sunworld Industrial Co., Ltd., Tainan Hsien ( * ) Notice: Subject to any disclaimer, the term of this patent is extended or adjusted under 35 U.S.C. 154(b) by 420 days.

(21) Appl. No.: 11/760,453

(22) Filed: Jun. 8, 2007

(65) Prior Publication Data

US 2008/0087265 A1 Apr. 17, 2008

Related U.S. Application Data

(63) Continuation-in-part of application No. 11/549,246, filed on Oct. 13, 2006, now Pat. No. 7,500,478.

(51) Int. Cl.
*F41B 11/00* (2006.01)

(52) U.S. Cl. ..... 124/72

(58) Field of Classification Search ..... 124/72–77
See application file for complete search history.

(56) References Cited

U.S. PATENT DOCUMENTS

| | | | | |
|---|---|---|---|---|
| 2004/0084040 | A1* | 5/2004 | Jones | 124/77 |
| 2005/0115554 | A1* | 6/2005 | Jones | 124/74 |
| 2007/0209650 | A1* | 9/2007 | Jones | 124/73 |
| 2009/0032003 | A1* | 2/2009 | Masse | 124/73 |

* cited by examiner

*Primary Examiner*—Troy Chambers
(74) *Attorney, Agent, or Firm*—WPAT, P.C.; Anthony King

(57) ABSTRACT

A paintball gun percussion mechanism includes a barrel, a propeller, and a bolt. The barrel contains a first air chamber and a second air chamber connecting through a first airway and a second airway. The propeller is inserted into the barrel. The bolt is provided with a plate insert to relatively seal the propeller. A retaining wall provided on the propeller reciprocally moves in the first chamber to launch a projectile by taking in or out air in the first and the second airways.

6 Claims, 8 Drawing Sheets

PAINTBALL GUN PERCUSSION STRUCTURE

CROSS-REFERENCE TO RELATED APPLICATIONS

This application is a continuation-in-part of my application filed Oct. 13, 2006, Ser. No. 11/549,246.

BACKGROUND OF THE INVENTION (a) Field of the Invention

The present invention relates to a paintball gun percussion mechanism, and more particularly to a propeller provided with a retaining wall to reciprocally move between a first airway and a second airway in a barrel to launch a projectile.

(b) Description of the Prior Art

U.S. Pat. Nos. 5,881,707, 5,967,133, 6,035,843, 6,474,326, and 6637421 disclosed a 2-step percussion mechanism of a paintball gun of the prior art. As shown in FIG. 7, a percussion mechanism includes a barrel (B), a piston (C), and a push rod (D). The piston (C) is disposed in a middle section of the barrel (B). The push rod (D) is disposed in a rear section of the barrel (B) to constitute 2-step percussion mechanism operating on two separately provided portions. Accordingly, gas is separately inputted into the middle section and the rear section of the barrel (B). The air input to the rear section of the barrel (B) is used to propel the push rod (D) for the push rod (D) to plunge against the piston (C) to slide in the barrel (B) thus to push a paint pellet, which is in turn fired when the pressure of the air in the middle section of the barrel (B) becomes higher than that of a critical point.

FIG. 8 shows another prior art as taught in U.S. Pat. Nos. 6,810,871, 7,044,119, 7,121,272, and 7,185,646. A paintball gun percussion mechanism includes a barrel (E), a front outer box (F), a rear outer box (G), a propeller (H) and a bolt (I). Both the front outer box (F) and the rear outer box (G) are mounted in the barrel (E) and penetrated by the propeller (H). One end of the propeller (H) is inserted by the bolt (I). Each of the front outer box (F) and the rear outer box (G) has provided on their inner walls a retaining wall and a washer; and corresponding retaining wall and washer are provided on the outer wall of the propeller (H) for the propeller (H) to slide back and forth in the front outer box (F) and the rear outer box (G). Compressed air is filled in the rear outer box (G) to push forward the propeller (H) into the front outer box (F). Once the propeller (H) clears out of the bolt (I), the compressed air stored in the rear outer box (G) is conducted into the propeller (H) to propel a paint pellet.

However, either of the prior art is comprised of multiple different members which consume longer time in assembly and higher production cost; the assembly comprised of multiple members is vulnerable to failure and makes service inconvenient; furthermore, multiple retaining walls and washers cause great friction by consuming too much compressed air and are subject to earlier tear and wear.

SUMMARY OF THE INVENTION

The primary purpose of the present invention is to provide a paintball gun percussion mechanism comprising a single propeller adapted to spatial configuration of a barrel to achieve a summary construction for solving problems of more complicated construction, vulnerability to failure, and higher production costs found with the prior art.

To achieve the purpose, the present invention comprises:

a barrel being a hollow tube and containing a slide guide cavity, a first air chamber, a second air chamber, a first airway, a second airway, and a first airtight ring, an internal diameter of the slide guide cavity being smaller than that of the first air chamber, an internal diameter of the first air chamber being smaller than that of the second air chamber, the slide guide cavity, the first air chamber, and the second air chamber connecting through one another in sequence, the first airtight ring being disposed in the slide guide cavity, a first gradation being formed between the slide guide cavity and the first air chamber, a second gradation being formed between the first air chamber and the second air chamber, the first air chamber being located between the first gradation and the second gradation, the first airway being disposed next to the first gradation, the first airway connecting through the first air chamber, the second airway being disposed next to the second gradation, the second airway connecting through the second air chamber;

a propeller being a hollow tube disposed in the barrel and having an outer diameter corresponding to the internal diameter of the slide guide cavity, the first airtight ring holding against an outer wall of the propeller, at least one retaining wall, a second airtight ring, and a first buffer ring being disposed on the outer wall of a middle section of the propeller, an outer diameter of the retaining wall corresponding to the internal diameter of the first air chamber, the second airtight ring holding against an inner wall of the first air chamber, the first buffer ring being disposed between the retaining wall and the first gradation, an outer diameter of the first buffer ring being smaller than the inner wall of the first air chamber; and a bolt fixed to and closing up the second air chamber, a plate insert being disposed at a front end of the bolt, the plate insert being disposed with a third airtight ring to relatively close upon an inner wall of the propeller.

Preferably, two retaining walls are provided on the outer wall of the middle section of the propeller.

Preferably, an internal diameter of one end of the propeller is enlarged to form a ring gradation; the plate insert relatively holds against the ring gradation; and the ring gradation is an incline.

Preferably, the bolt is provided with a second buffer ring to relatively hold against the propeller.

Preferably, a fourth airtight ring is disposed between the barrel and the bolt.

The present invention provides the following advantages:

1. Free of intervention or interference. When fired, the propeller and the bolt will not cause intervention or interference to each other since the propeller is separated from the bolt.
2. Short firing time lapse. Whereas propelling a paint pellet and air storage are synchronously processing, the time required for refill of compressed air is shortened, thus achieving shorter firing time lapses.
3. Decreased friction. Reduced number of airtight rings adapted to moving parts decreases friction to allow faster operation.
4. Fewer members permit summary construction and easy dismantle.
5. Low failure. Simple construction naturally reduces chance of failure.
6. Lower cost. Simple construction, easy process, and convenient assembly contribute to cost reduction.

DETAILED DESCRIPTION OF THE PREFERRED EMBODIMENTS

Figure 1:
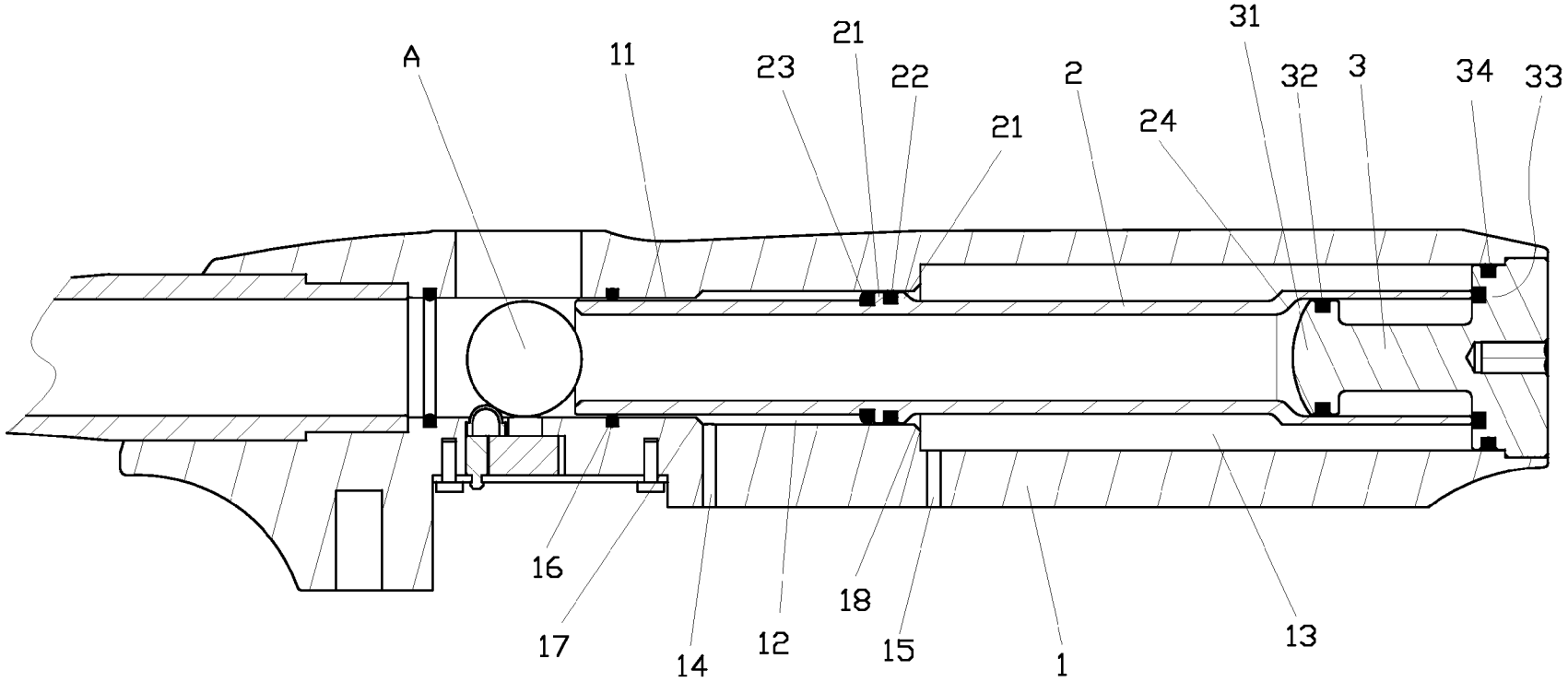
FIG. 1 is a sectional view of a preferred embodiment of the present invention applied to a paintball gun.

Referring to FIG. 1, a preferred embodiment of the present invention comprises a barrel (1), a propeller (2) and a bolt (3).

The barrel (1) is a hollow tube and includes a slide guide cavity (11), a first air chamber (12), a second air chamber (13), a first airway (14), a second airway (15), and a first airtight ring (16). The internal diameter of the slide guide cavity (11) is smaller than that of the first air chamber (12). The internal diameter of the first air chamber (12) is smaller than that of the second air chamber (13). The slide guide cavity (11), the first air chamber (12), and the second air chamber (13) connect through one another in sequence. The first airtight ring (16) is disposed in the slide guide cavity (11). A first gradation (17) is formed at where the slide guide cavity (11) and the first air chamber (12) are connected to each other. A second gradation (18) is formed at where the first air chamber (12) and the second air chamber (13) are connected to each other. The first air chamber (12) is located between the first gradation (17) and the second gradation (18). The first airway (14) is disposed next to the first gradation (17). The first airway (14) connects through the first air chamber (12). The second airway (15) is disposed next to the second gradation (18). The second airway (15) connects through the second air chamber (13).

The propeller (2) is a hollow tube disposed in the barrel (1). The outer diameter of the propeller (2) corresponds to the internal diameter of the guide slide cavity (11) of the barrel (1). The first airtight ring (16) holds against the outer wall of the propeller (2). At least one retaining wall (21), a second airtight ring (22) and a first buffer ring (23) are disposed on the outer wall of the middle section of the propeller (2). The outer diameter of the retaining wall (21) corresponds to the internal diameter of the first air chamber (12) of the barrel (1). The second airtight ring (22) holds against the inner wall of the first air chamber (12). The first buffer ring (23) is disposed between the retaining wall (21) and the first gradation (17). The outer diameter of the first buffer ring (23) is smaller than the internal diameter of the first air chamber (12) of the barrel (1) to absorb shock between the retaining wall (21) and the first gradation (17) so as to avoid damage to the retaining wall (21) and the first gradation (17) due to impact against each other and to also prevent noise generated from the impact. Smaller outer diameter designed for the buffer ring (23) also reduces unnecessary friction. In the drawings, two retaining walls (21) are parallel to each other, the second airtight ring (22), and the first buffer ring (23) are disposed on the outer wall of the middle section of the propeller (2).

The bolt (3) fixed to the second air chamber (13) of the barrel (1) and closing upon the second air chamber (13) has at its front end disposed with a plate insert (31). The plate insert (31) is provided with a third airtight ring (32) corresponding to and closing upon the inner wall of the propeller (2). The bolt (3) is provided with a second buffer ring (33) to hold against the end of the propeller (2). A fourth airtight ring (23) is disposed between the barrel (1) and the bolt (3). In the preferred embodiment, the internal diameter of one end of the propeller (2) is enlarged to form a ring gradation (24). The plate insert (31) relatively holds against the ring gradation (24). As illustrated, the ring gradation (24) is an incline while the plate insert (31) is a corresponding arc (as illustrated) or an incline.

Figure 2:
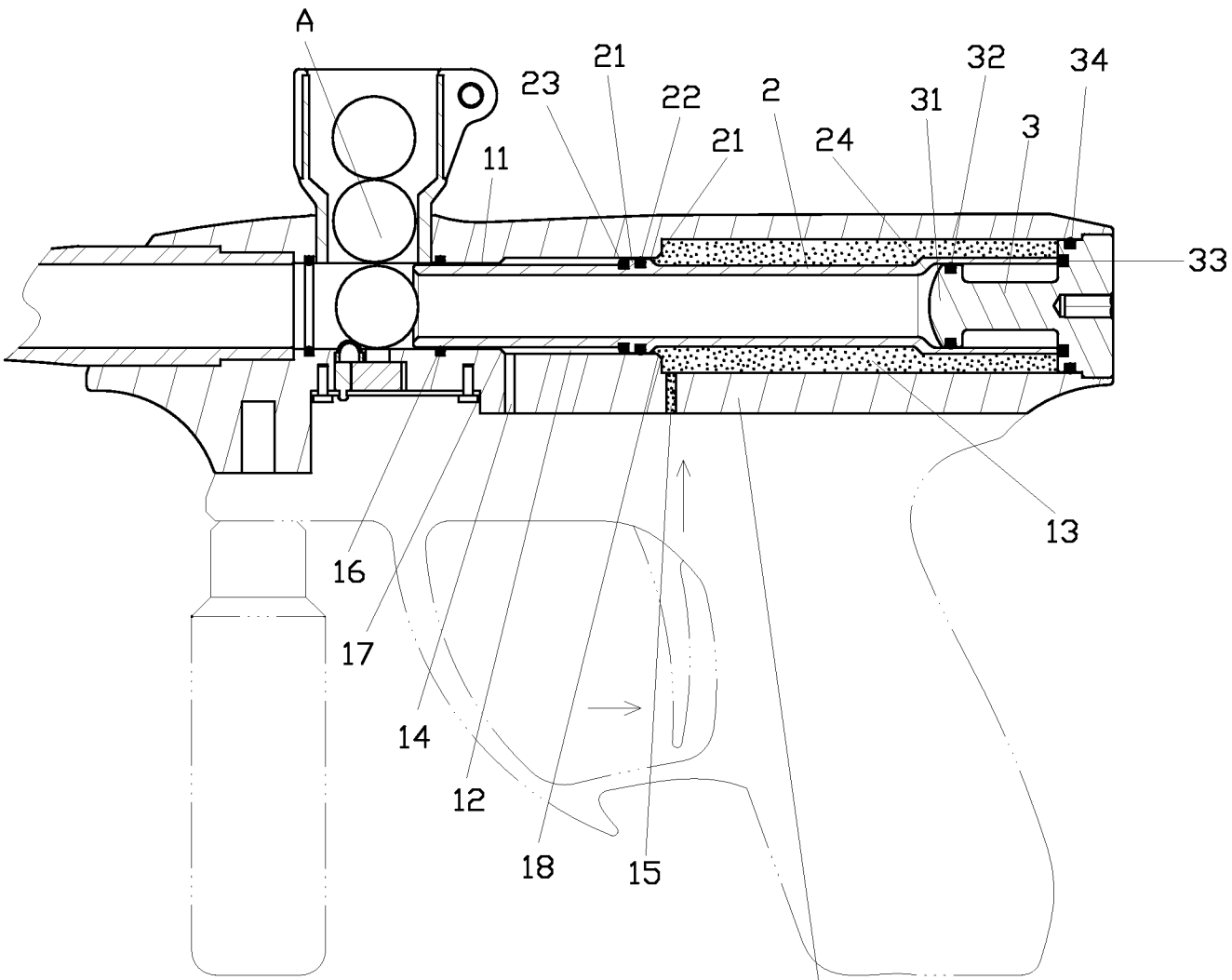
FIG. 2 is a schematic view of the preferred embodiment of the present invention in a status of compressed air being stored in an air chamber.
Figure 3:
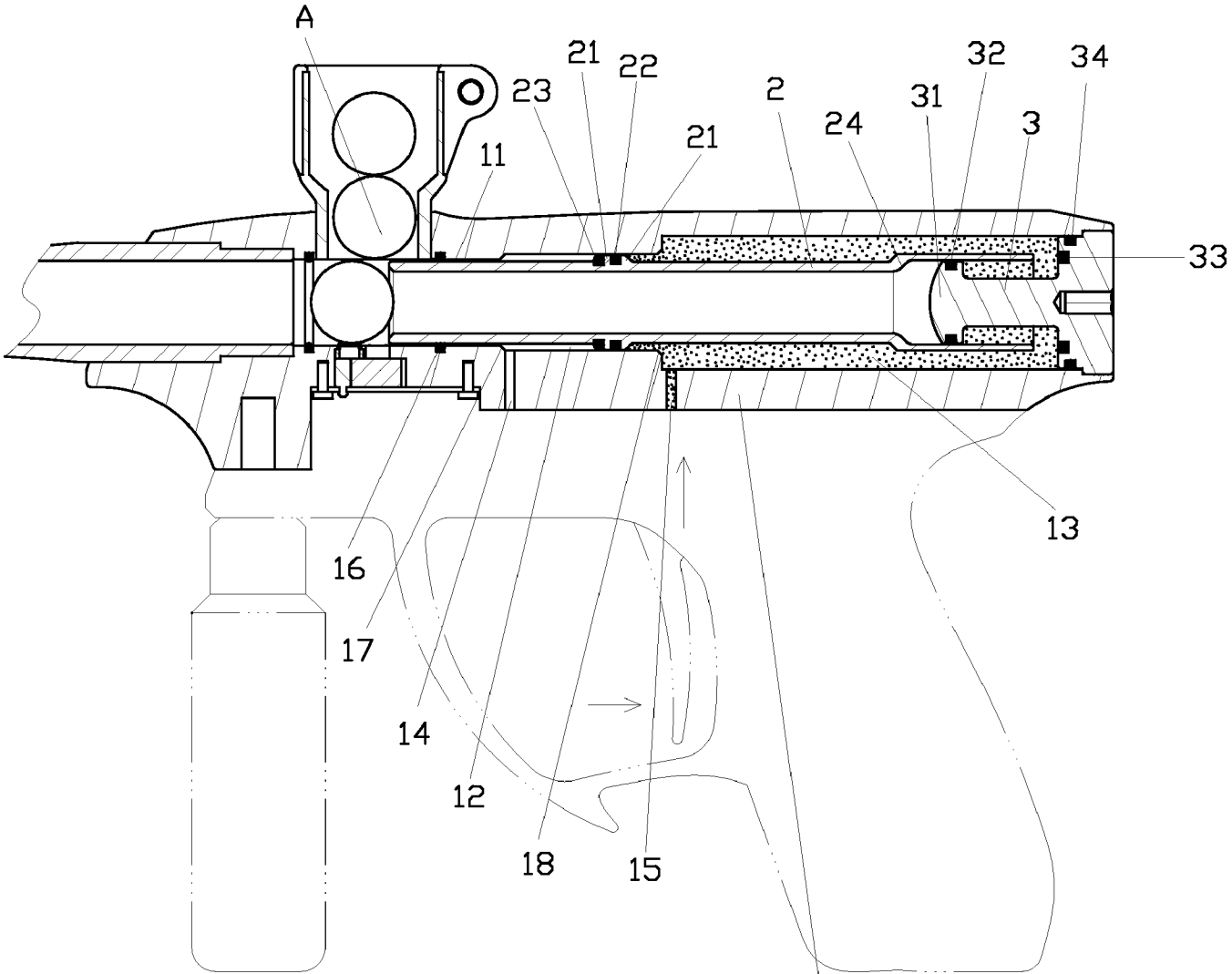
FIG. 3 is a schematic view of the preferred embodiment of the present invention in a status of pushing a paint pellet.

Upon propelling as illustrated in FIG. 2, both the first airway (14) and the second airway (15) of the barrel (1) are respectively connected to compressed air. Compressed air is supplied to the second air chamber (13) of the barrel (1) through the second airway (15) subject to control by a solenoid (a prior art and irrelevant to the present invention, thus not elaborated upon). The first airway (14) starts to exhaust; meanwhile the second airtight ring (22) of the propeller (2) tightly holds against the inner wall of the first air chamber (12) of the barrel (1) and the third airtight ring (32) of the bolt (3) tightly holds against the inner wall of the propeller (2) to constitute an airtight space for storage of compressed air. When compressed air continues to enter through the second airway (15) into the second air chamber (13), air pressure inside the second air chamber (13) increases pressure to move the retaining wall (21) of the propeller (2); in turn the retaining wall (21) and the propeller (2) slide from closer to the second airway (15) to the first airway (14) while a gap as illustrated in FIG. 3 is created between the end of the propeller (2) and the second buffer ring (33); accordingly, compressed air in the second air chamber (13) flows into the propeller (2) and is stored therein since it is prevented from being released due to stoppage by the plate insert (31) and the third airtight ring (32).

Figure 4:
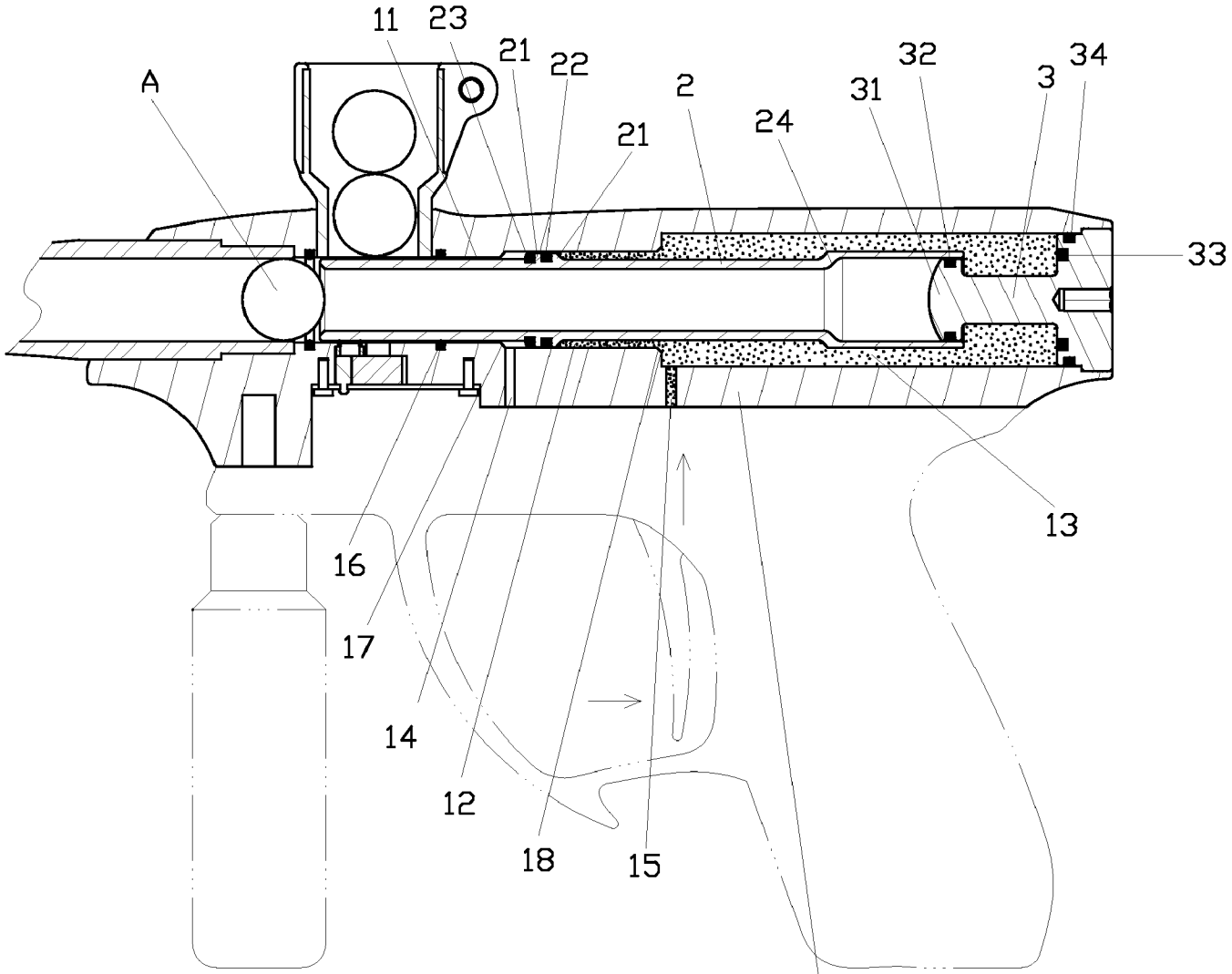
FIG. 4 is a schematic view of the preferred embodiment of the present invention in another status of pushing the paint pellet.

Now referring to FIG. 4, compressed air in the second air chamber (13) remains pushing against the retaining wall (21) and the rear end of the propeller (2) thus accelerating the propeller (2) to slide until the retaining wall (21) of the propeller (2) approaches the first gradation (17) next to the first airway (14) and the propeller (2) pushes a paint pellet (A) to move.

Figure 5:
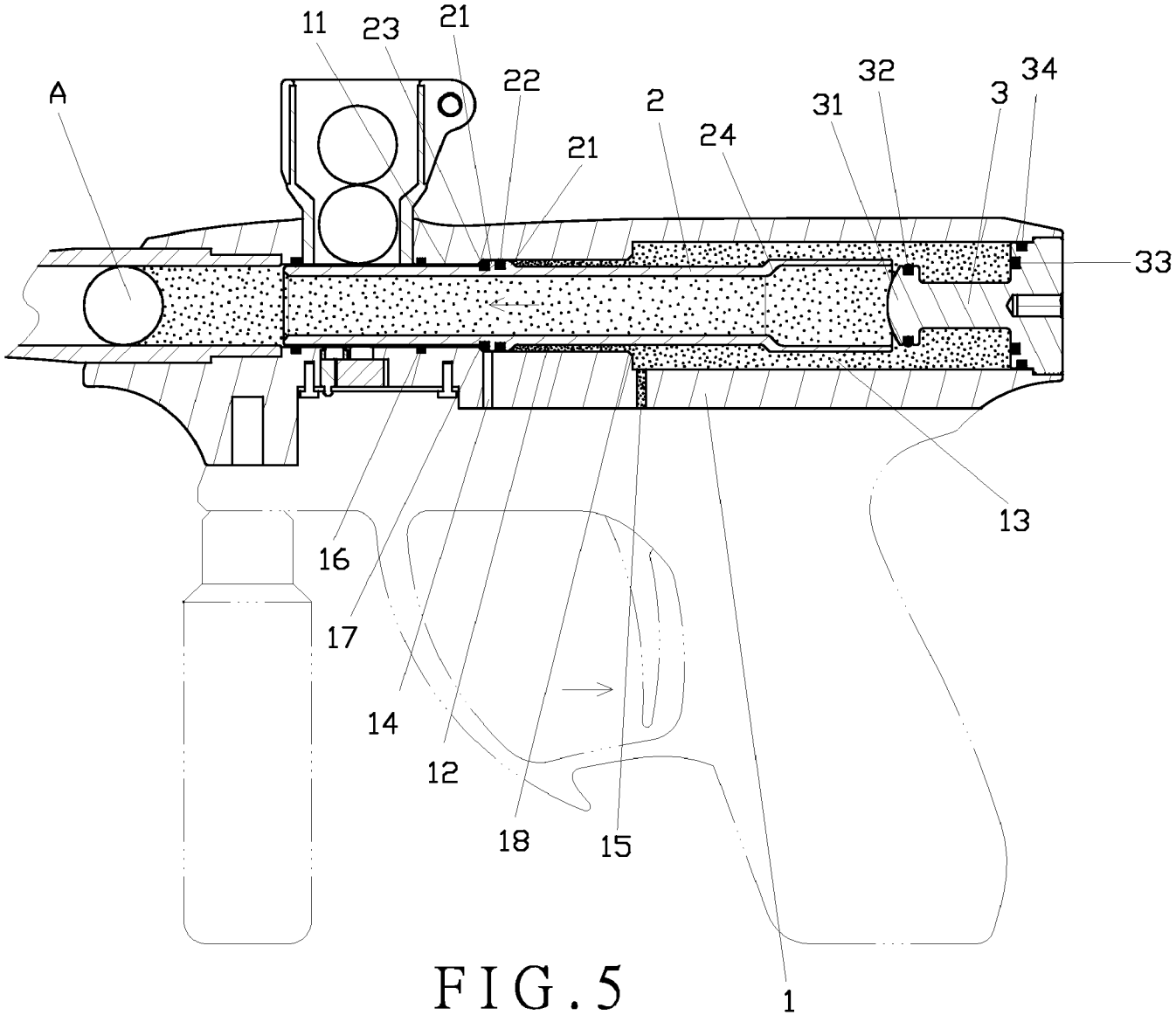
FIG. 5 is a schematic view of the preferred embodiment of the present invention in a status of firing.

As illustrated in FIG. 5, when the retaining wall (21) of the propeller (2) holds against the first gradation (17), the propeller (2) clears off the plate insert (31) of the bolt (3) without being tightly held against by the third airtight ring (32), the compressed air enters from the end of the propeller (2) into the propeller (2) to fire the paint pellet (A).

Figure 6:
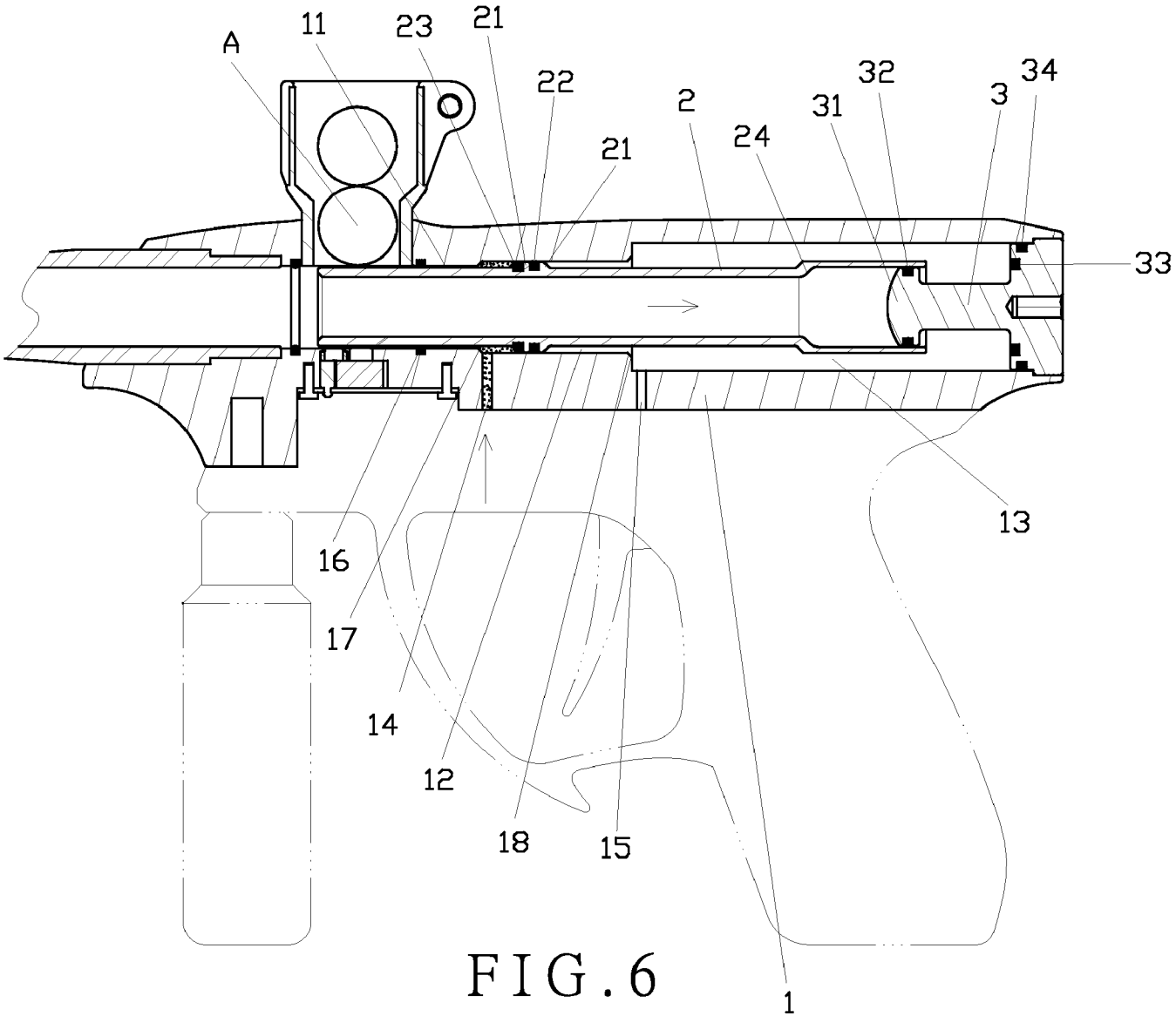
FIG. 6 is a schematic view of the preferred embodiment of the present invention showing a propeller being pushed back by the compressed air after having fired the paint pellet.
Figure 7:
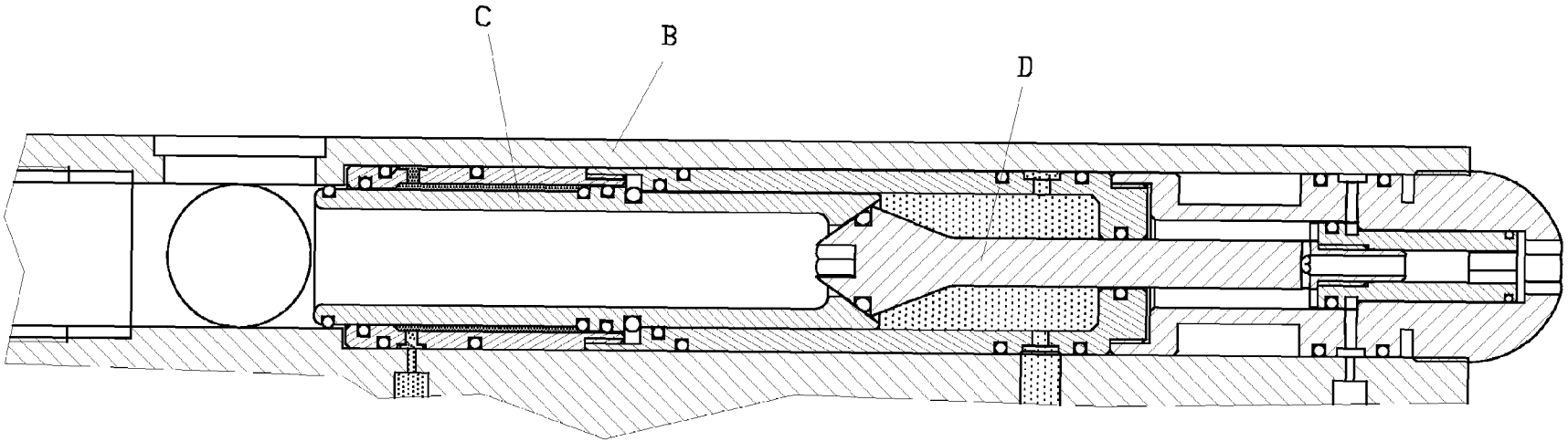
FIG. 7 (PRIOR ART)
FIG. 7 is a schematic view showing a paintball gun with a 2-step propelling mechanism of the prior art.
Figure 8:
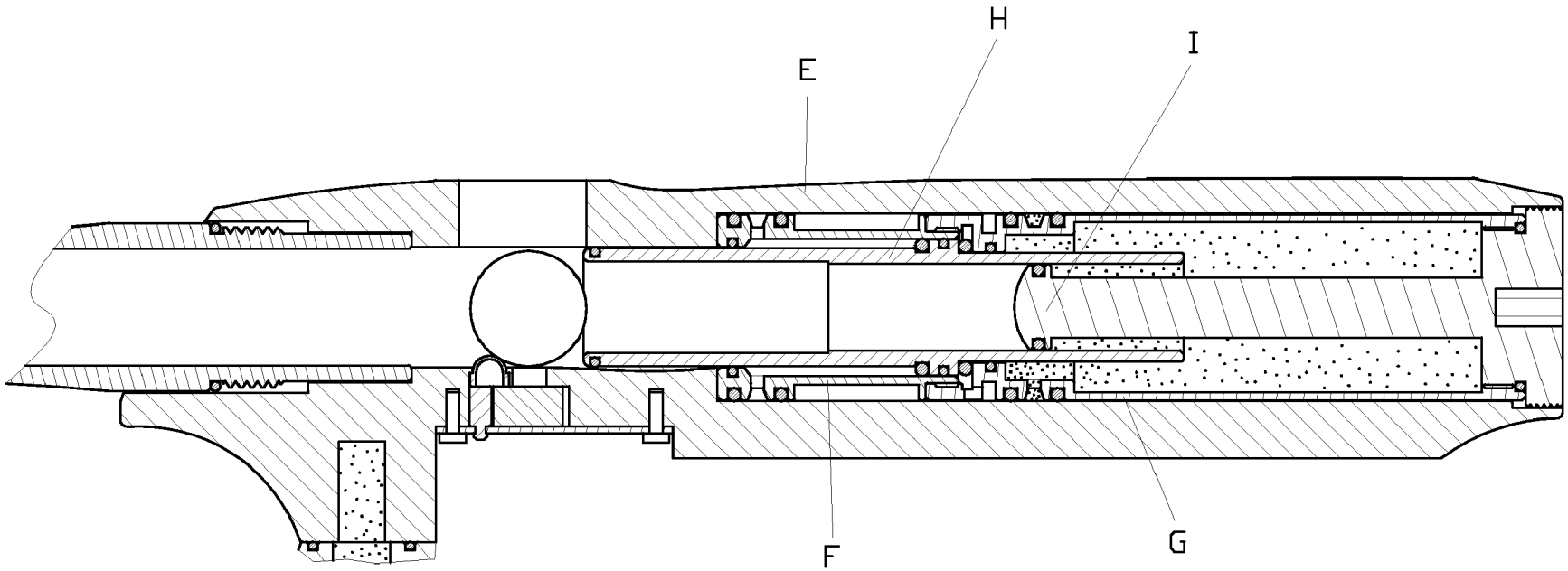
FIG. 8 (PRIOR ART)
FIG. 8 is a schematic view showing a paintball gun propelling mechanism of another prior art.

After the paint pellet (A) is fired, the retaining wall (21) as pushed by compressed air injected from the first airway (14) starts to move from a location next to the first airway (14) to the second airway (15); and the propeller (2) returns to its position before the firing at where closer to the plate insert (31) of the bolt (3). As illustrated in FIG. 6, the third airtight ring (32) of the bolt (3) once again tightly holds against the internal wall of the propeller (2). The propeller (2) continues to slide until the second buffer ring (35) of the bolt (3) tightly holds against the end of the propeller (2) to get ready for the next round of firing another paint pellet.

What is claimed is:

1. A paintball gun percussion mechanism, comprising:

a barrel being a hollow tube and containing a slide guide cavity, a first air chamber, a second air chamber, a first airway, a second airway, and a first airtight ring, an internal diameter of the slide guide cavity being smaller than that of the first air chamber, an internal diameter of the first air chamber being smaller than that of the second air chamber, the slide guide cavity, the first air chamber, and the second air chamber connecting through one another in sequence, the first airtight ring being disposed in the slide guide cavity, a first gradation being formed between the slide guide cavity and the first air chamber, a second gradation being formed between the first air chamber and the second air chamber, the first air chamber being located between the first gradation and the second gradation, the first airway being disposed next to the first gradation, the first airway connecting through the first air chamber, the second airway being disposed next to the second gradation, the second airway connecting through the second air chamber;

a propeller being a hollow tube disposed in the barrel and having an outer diameter corresponding to the internal diameter of the slide guide cavity, the first airtight ring holding against an outer wall of the propeller, at least one retaining wall, a second airtight ring, and a first buffer ring being disposed on the outer wall of a middle section of the propeller, an outer diameter of the retaining wall corresponding to the internal diameter of the first air chamber, the second airtight ring holding against an inner wall of the first air chamber, the first buffer ring being disposed between the retaining wall and the first gradation, an outer diameter of the first buffer ring being smaller than the inner wall of the first air chamber; and a bolt fixed to and closing up the second air chamber, a plate insert being disposed at a front end of the bolt, the plate insert being disposed with a third airtight ring to relatively close upon an inner wall of the propeller.

2. The paintball gun percussion mechanism as claimed in claim 1, wherein two retaining walls are provided on the outer wall of the middle section of the propeller.

3. The paintball gun percussion mechanism as claimed in claim 1, wherein an internal diameter of one end of the propeller is enlarged to form a ring gradation; and the plate insert relatively holds against the ring gradation.

4. The paintball gun percussion mechanism as claimed in claim 3, wherein the ring gradation is an incline.

5. The paintball gun percussion mechanism as claimed in claim 1, wherein the bolt is provided with a second buffer ring to relatively hold against the propeller.

6. The paintball gun percussion mechanism as claimed in claim 1, wherein a fourth airtight ring is disposed between the barrel and the bolt.

* * * * *